United States Patent [19]

Bibber

[11] Patent Number: 4,755,224

[45] Date of Patent: Jul. 5, 1988

[54] CORROSION RESISTANT ALUMINUM COATING COMPOSITION

[75] Inventor: John W. Bibber, Batavia, Ill.

[73] Assignee: Sanchem, Inc., Chicago, Ill.

[21] Appl. No.: 86,362

[22] Filed: Aug. 17, 1987

Related U.S. Application Data

[63] Continuation-in-part of Ser. No. 908,827, Sep. 18, 1986, Pat. No. 4,711,667.

[51] Int. Cl.[4] ..... C23F 11/18

[52] U.S. Cl. ..... 106/14.21; 148/6.27

[58] Field of Search ..... 106/14.21; 148/6.27

[56] References Cited

U.S. PATENT DOCUMENTS

| | | | |
|---|---|---|---|
| 3,039,899 | 6/1962 | Keller et al. | 148/6.27 |
| 3,516,877 | 6/1970 | Papafingos et al. | 148/6.27 |

*Primary Examiner*—Robert Wax

*Attorney, Agent, or Firm*—Laff, Whitesel, Conte & Saret

[57] ABSTRACT

An aluminum conversion coating composition for aluminum or an aluminum alloy. The composition has as essential ingredients alkali metal permanganate, and alkali metal chloride, and a pH of 7 to less than 12.5. The composition may also contain a buffer, such as alkali metal tetraborate, alkali metal metaborate, benzoic acid, alkali metal benzoate, alkali metal carbonate and a mixture of the alkali metal tetra-and metaborates. I also provide a coating composition which contains alkali meal permanganate, an alkali metal silicate and a buffer. This silicate composition has a pH as high as 14. My compositions are effective for protecting the aluminum and aluminum alloys for sufficient hours in salt fog at 95° F. according to standard ASTM method B-117. I also provide a process of coating the aluminum or aluminum alloy by cleaning the aluminum or aluminum alloy to a break-free surface with commercial non-ionic surfactants of polyoxyethylene or polyoxypropylene derivatives of organic acids, alcohols, alkyphenols or amines. Then coating the cleaned aluminum alloy with the permanganate composition.

38 Claims, No Drawings

CORROSION RESISTANT ALUMINUM COATING COMPOSITION

This is a continuation-in-part application of my patent application No. 06/908,827 filed Sept. 18, 1986, now U.S. Pat. No. 4,711,667.

The present invention relates to a corrosion resistant coating for aluminum and aluminum alloys and the process for coating aluminum and aluminum alloys with a protective corrosion resistant coating.

BACKGROUND OF THE INVENTION

Generally, aluminum or aluminum alloys are protected by forming thereon an intermediate corrosion resistant conversion coating and then painting over the corrosion resistant coating. Therefore, the corrosion resistant coating must be intimately bonded to the aluminum surface and also provide the required adhesion with the desired final aluminum coating—i.e., paint.

One of the widely used processes for protecting aluminum and aluminum alloys with a corrosion resistant intermediate coating is to coat the surface of the aluminum and aluminum alloys with a protective conversion coating of an acid based hexavalent chromium composition.

Hexavalent chromium has been widely accepted as an intermediate corrosion resistant conversion coating because it protects the aluminum and aluminum alloy chromium provides a corrosion resistant coating which can withstand a salt fog bath for more than 168 hours. The coated aluminum or aluminum alloy is placed in a salt fog at 95° F. according to ASTM method B-117 for at least 168 hours and then removed. This requirement is necessary for many applications. Further, the hexavalent chromium composition provides an intermediate coating which is receptive to the application and retention of other coatings, such as paints, to the aluminum or aluminum alloy surfaces.

The excellent features of the hexavalent chromium composition have made these compositions used extensively for the corrosion resistant protections of aluminum and aluminum alloys and as an intermediate corrosion resistant coating.

However, the hexavalent chromium compositions have a serious side effect. Chromium is highly toxic and the spent chromium compositions provide an ecological problem. Many people in the industry are attempting to eliminate this ecologically damaging waste problem and it is very costly.

Other corrosion resistant compositions have been suggested, but they have not been as successful as the hexavalent chromium compositions.

In 1940 Collari reported for the first time on the inhibiting action of potassium permanganate against attack by sodium hydroxide on aluminum. (*Chemical Abstracts* 5814–6, Volume 34, 1940). In 1941 Lilli Reschke and Heinrick Neunzig (*Chemical Abstracts*, Vol. 36, 1942, 5760-5-7) reported the first study on the inhibiting action of potassium permanganate against the attack by sodium hydroxide on aluminum. Finally, in 1947 (*Chemical Abstracts* 4759 e.g., Vol. 41, 1947) Collari and Fongi also compared the inhibiting action of potassium permanganate to sodium chromate in inhibiting attack by sodium hydroxide on aluminum at various temperatures.

Various compositions of sodium chromate and sodium hydroxide were utilized, and sheets of aluminum were emersed in these solutions. The solutions all had a pH of 12.5 or greater than 12.5.

It was appreciated, after these articles, that the most effective corrosion resistant coatings were those which are acid based. The basic compositions of hexavalent chromium were not effective for prolonged corrosion protection of aluminum surfaces. Neither the basic chromium nor the basic permanganate which have a pH of greater than 12.5, would be appropriate for the corrosion resistant coating of aluminum wherein the aluminum requires a corrosion protection in a salt fog of greater than 168 hours. Further, the industry decided that the basic compositions were inadequate for their purposes because highly basic solutions attacked aluminum surfaces. The industry has concentrated their efforts on acid based conversion coating compositions.

In some applications, the acid chromate composition was combined with potassium permanganate to form a black coating. The pH of the solution stayed in the preferred range of 2–3, U.S. Pat. No. 4,145,234.

Also, it has been suggested, that the use of the oxidizing agents, sodium or potassium chromate and potassium permanganate, may be added to an electrolyte solution to inhibit the corrosion of aluminum electrodes.

In the immersion coating of aluminum with a chromium coating, the thickness of the chromium coating is usually varied by the amount of time the aluminum or aluminum alloy was in contact with the corrosion resistant composition.

U.S. Pat. No. 3,516,877 illustrates coating a 5051 aluminum alloy irrigation pipe with NaOH and $KMnO_4$. The particular alloy used by U.S. Pat. No. 3,516,877 is generally a corrosion resistant alloy and presently is not widely used. The patent does not give any specific indications of the protection provided, but merely states that the pipe withstood corrosion. When I directly compared the composition of the U.S. Patent with my composition, my composition had a substantial increase in corrosion resistance.

SUMMARY OF THE INVENTION

My invention eliminates some of the problems of the hexavalent chromium compositions by providing a corrosion resistant coating composition which, if desired, contains no chromium or other similar toxic materials. Also, for those applications which require it, we provide a corrosion resistant coating for aluminum or aluminum alloy surfaces which can withstand a salt fog at 95° F. according to ASTM Method B-117 for at least 168 hours, and which when desired, will provide an excellent intermediate coating.

Also, we eliminate the need for special handling, which is sometimes required by acid solutions, by providing a basic coating composition which can, if desired, contain no chromium.

Accordingly, this invention is directed to providing a protective coating for aluminum and aluminum alloys, which has as essential ingredients, an alkali metal permanganate and an alkali metal chloride in a solution having a pH in the range of 7 to less than 12.5.

Another aspect of this invention is to provide a protective coating for aluminum and aluminum alloys, which has as essential ingredients, an alkali metal permanganate, alkali metal silicate, a buffer and, if desired, one or both of alkali metal chloride and alkali metal nitrate and having base pH of up to 14.

Another aspect of the invention is to provide a protective corrosion resistant coating for aluminum and aluminum alloys of the 2000, 3000, 6000, and 7000 series which comprises as an essential ingredient an alkali metal permanganate, a salt selected from the group consisting of alkali metal chloride, alkali metal nitrate and mixtures thereof, and a buffer compound selected from alkali metal tetraborate, alkali metal metaborate, benzoic acid, alkali metal benzoate, alkali metal carbonate and a mixture of the alkali metal tetraand metaborates.

It is still another object of the present invention to provide a method for protecting aluminum and aluminum alloys with a protective corrosion resistant coating comprising coating the aluminum or aluminum alloy with a corrosion resistant coating composition containing as essential ingredients, an alkali metal permanganate, an alkali metal chloride, and, if desired, sodium silicate, borax, alkali metal nitrate, and mixtures thereof and said composition having a base pH of up to 14.0.

It is still another object of the present invention to provide an aluminum or aluminum alloy corrosion resistant coating composition which has as essential ingredients, an alkali metal permanganate and an alkali metal chloride salt and, if desired, also one or more of hydrated alkali silicate, alkali metal nitrate, and buffer compounds selected from the group consisting of alkali metal tetraborate, alkali metal metaborate, benzoic acid, alkali metal benzoate, alkali metal carbonate, and a mixture of the alkali metal tetra-and metaborates.

Still another aspect of the present invention is to clean the aluminum or aluminum alloy surfaces with an appropriate cleaning solution which will not interfere with the bonding of the corrosion resistant coating onto the surfaces of the aluminum or aluminum alloys. Preferred cleaning solutions are the alkali nitrate solutions, i.e., sodium nitrate solution; alkali metal hydroxides—i.e., sodium hydroxide; hydrofluoric acid; borax; sulfuric acid, nitric acid, and a commercial non-ionic surfactant, of polyoxyethylene or polyoxypropylene derivatives of organic acids, alcohols, alkyphenols or amines.

The alkali metal permanganate composition may be applied in any acceptable manner (i.e., immersion, spraying, misting or spreading by an appropriate applicator).

The pH of the composition without silicate is between 7 and less than 12.5. The preferred pH range is about 9 to 10.

The pH of the composition with silicate is up to 14 with the range generally being 12–14.

The aluminum or aluminum alloy surface is normally immersed in my aqueous alkali metal permanganate solution which contains the essential ingredients. The temperature of the solution is between room temperature and the boiling point of the composition. The preferred temperature is between 60° and 180° F., with the most preferred between 100° and 180° F. However, as the temperature is raised, less immersion time is necessary to form the corrosion resistant coating on the aluminum or aluminum alloy surfaces.

The alkali metal as referred to herein is selected from potassium, sodium or lithium.

The preferred alkali metal permanganate is potassium or sodium permanganate. The concentration of the permanganate, to provide 168 hours of salt fog protection for the aluminum or aluminum alloys, is of a sufficient amount to provide at least 700 ppm of Manganese in the coating solution with the practical maximum being the saturation point of the permanganate. When potassium permanganate is used, a concentration of 0.2% by weight is about 700 PPM manganese. At room temperature, a saturated $KMnO_4$ solution is 6.3% by weight; 32° F. is 2.8% by weight and at 212° F. is 28% by weight. The sodium permanganate is infinitely soluble and, therefore, has no practical upper limit.

The preferred alkali metal Chloride is NaCl or LiCl. The concentration of the NaCl or LiCl is generally within the range of 0.05–10% by weight of the solution and preferably within the range of 0.1 to 5% by weight of the solution.

The alkali metal phosphate is preferably $K_2(HPO_4)$ The concentration of $K_2(HPO_4)$ when used is within the range of 0.1% to 1% by weight of the solution with the preferred being 0.5% by weight of the solution.

The alkali metal silicate is preferably hydrated and the preferred compound is sodium silicate pentahydrate, $Na_2SiO_3.5H_2O$. The concentration of the $Na_2SiO_3.5H_2O$ when used is generally within the range of 0.1–40% by weight. The preferred alkali metal nitrate is $LiNO_3$ or $NaNO_3$. The concentration of $NaNO_3$ and/or $LiNO_3$ when used is within the range of 0.05–10% by weight of the solution and preferably 0.1% to 5% by weight of the solution.

The buffers, which we can use in our composition, are alkali metal tetra-and metaborate, benzoic acid, alkali metal benzoate, and the alkali metal carbonates. The benzoic acid is used only in quantities which will not lower the pH to less than 7. If the quantity of benzoic acid is too great, NaOH can be added to neutralize the acid or change it to sodium benzoate. In any event, the pH of composition is not to fall below 7. The tetraborate is preferably a hydrated tetraborate, and the hydrated sodium tetraborate is commonly referred to as borax i.e., $Na_2B_4O_7.10\ H_2O$. In our examples, we use borax-5.$H_2O$; i.e., $Na_2B_4O_7.5\ H_2O$. It is our understanding that the non-hydrated borates are equivalent to the hydrated borates, and that the 10 hydrated borax is equivalent to the 5-hydrated borax with the exception of the 10-hydrated borax containing more water of hydration. The preferred buffers are borax-5.$H_2O$, alkali metal benzoate and sodium carbonate. The preferred concentration of alkaline metal benzoate is 0.05% to 44.0% by weight of the solution. The preferred concentration of $Na_2CO_3$ is 0.05% to 31.5% by weight of the solution.

The preferred immersion time, for preparing a corrosion inhibiting coating on aluminum or aluminum alloy surfaces, is approximately one minute at 155° F. and approximately one hour at room temperature. A longer immersion time than the predetermined optimum time does not increase the coating thickness to any appreciable amount and, therefore, would not be economically worthwhile.

Other compounds may be added, if desired, providing the compounds do not interfere with the desired corrosion resistant protection of the aluminum or aluminum alloy surfaces.

The cleaning compounds for the aluminum or aluminum alloy surfaces are sodium hydroxide, alkaline solutions of sodium nitrate, hydrofluoric acid, sulfuric acid, nitric acid, sodium carbonate, borax, and a commercial non-ionic surfactant, polyoxyethylene or polyoxypropylene derivatives of organic acids, alcohols, alkylphenols or amines. A commercial non-ionic surfactant which I have used is a polyoxyethylene derivative of organic acids such as "Triton X-100" sold by Rohm and Haas Corp., which are less dangerous to use than sodium hydroxide or hydrofluoric acid.

It is also recommended that neither the cleaning composition nor the corrosion resistant alkali metal permanganate composition contain a fatty acid, or any compound which would interfere with adhesion or formation of a protective coating on the aluminum or aluminum alloy surface.

The following examples 1 to 4 illustrate for comparative purposes the use of a composition of potassium permanganate and sodium hydroxide for coating aluminum. These examples show that NaOH composition does not provide the corrosion resistance for aluminum that is provided by my composition and process. In all of the following examples, all percentages are percentages by weight, unless otherwise indicated. In the following examples 1–10, an aluminum alloy panel is used which is made from the aluminum alloy (Alloy No. 3003 H14) purchased from Q-Panel Company of Cleveland, Ohio. It is understood that this alloy has more than 95% by weight of Aluminum and has on average a composition of by weight 96.4–96.75% Al, 0.6% Si, 0.7% Fe, 0.5%Cu, 1.2% Mn, 0.1% Zn and 0.15–0.5% maximum other elements as impurities.

EXAMPLE 1

(a) The aluminum alloy panel was degreased with mineral spirits and cleaned in a 0.1% sodium hydroxide solution for one minute at room temperature. The panel was rinsed and then immersed in a room temperature solution of 1% potassium permanganate, and 0.1% sodium hydroxide with the remainder being water. The aluminum panel was exposed for approximately 1 minute.

(b-d) The above procedure was repeated with solutions containing 0.5%, 1% and 2% sodium hydroxide.

In all of the above cases the panel was removed from the potassium permanganate-sodium hydroxide solution, rinsed with water, and then wiped. With the exception of the 1.0% and 2.0% sodium hydroxide solution, which left no film, a very thin tan coating remained. When placed in a salt fog at 95° F. according to ASTM method B-117, pitting began after a few hours of exposure.

EXAMPLE 2

The procedure of Example 1 was repeated with each of the solutions except the exposure time for each of the solutions was increased to one hour. A much thicker coating appeared on all of the aluminum panels. The coating did not completely wipe off. The panels were dried and placed in a salt fog at 95° F. according to standard ASTM method B-117. All the panels showed noticeable pitting after a few hours. The pitting was more extensive with the 2.0% solution than the 0.1% NaOH solution. Also, the panels subjected to the 1% and 2% NaOH solutions showed a substantial loss of aluminum from the panel.

EXAMPLE 3

The procedure of Example 1 was followed for each of the solutions except the temperature of each of the coating solutions were raised to and maintained at 155° F.

When the panels were removed after 1 minute of immersion, it was noted that there was considerable loss of aluminum metal especially with the 0.5%, 1% and 2% NaOH solutions and considerable pitting after being subjected to a few hours of salt fog at 95° F., ASTM method B-117. The loss of aluminum was greater as the concentration of the NaOH increased.

EXAMPLE 4

The procedure of Example 3 was followed for each of the solutions with each coating solution maintained at a temperature of 155° F. and the immersion time increased to 15 minutes.

When the panels were removed from the 0.5% and 1% NaOH solutions, they were rinsed, dried and subjected to an eight hour salt fog at 95° F. of ASTM method B-117. Considerable pitting was noted on each panel and more aluminum metal was lost than in Example 3. At 2% of NaOH, the aluminum metal strip used was entirely dissolved.

The loss of aluminum metal and the relatively short protection time is a serious drawback to the use of a sodium hydroxide-potassium permanganate composition. It is further noted, that the pH of all of the above solutions was 12.5 or greater.

The following examples illustrate the compositions and process of our invention. The examples are for illustrative purposes and are not intended to limit the invention to the specifics of each example. Aluminum alloy of the same composition used in Example 1–4 is used.

EXAMPLE 5

An aluminum panel was degreased with mineral spirits and than cleaned to a break-free surface with a commercial non-ionic surfactant of polyoxyethylene derivatives of organic acids, such as "Triton X-100". After rinsing with D.I. water, the panel was immersed for one minute at 155° F. in a solution consisting of:

5.0% Sodium Chloride (NaCl)
0.2% Potassium Permanganate ($KMnO_4$)
94.8% Water

The panel was rinsed off with water, dried and placed in a salt fog at 95° F. for 336 hours according to standard ASTM method, B-117. The panel showed no noticeable pits in the treated area.

EXAMPLE 6

An aluminum panel was degreased with mineral spirits and cleaned to a break-free surface with "Triton X-100". After rinsing with D.I. water, the panel was immersed for one minute at 155° F. in a solution consisting of:

4.0% Potassium Permanganate ($KMnO_4$)
0.1% Sodium Chloride (NaCl)
95.9% Water

The panel was rinsed off with water, dried and placed in a salt fog at 95° F. for 336 hours according to ASTM method B-117. The panel showed no noticeable pits in the treated area.

EXAMPLE 7

An aluminum panel was degreased with mineral spirits and cleaned to a break-free surface with Triton X-100. After rinsing with water, the panel was immersed for one minute at 155° F. in a solution consisting of:

0.1% Borax ($Na_2B_4O_7.5H_2O$)
0.1% Sodium Chloride (NaCl)
0.2% Potassium Permanganate ($KMnO_4$)
99.6% Water The panel was rinsed off with water, dried and placed in a salt-fog according to ASTM method, B-117 for 336 hours. The panel showed no pits in the treated area.

EXAMPLE 8

An aluminum panel was degreased in mineral spirits and cleaned to a break-free surface with Triton X-100. After rinsing with D.I. water, the panel was immersed for one minute at 155° F. in a solution consisting of:
1.0% Borax ($Na_2B_4O_7.5H_2O$)
2.0% Potassium Permanganate ($KMnO_4$)
97.0% Water
The panel was rinsed off with water, dried and placed in a salt-fog at 95° F. for 336 hours according to standard ASTM method, B-117. The panel showed no pits in the treated area.

EXAMPLE 9

An aluminum panel of "6061" alloy (has on average, a composition of by weight 0.60% Si, 0.28% Cu, 1.0% Mg, 0.20% Cr, 97.92% Al) was degreased with mineral spirits and cleaned to a break-free surface with Triton X-100. After rinsing with water, the panel was immersed for two minutes at 155° F. in a solution consisting of:
0.5% Borax ($Na_2B_4O_7.H_2O$)
0.5% Sodium Chloride (NaCl)
1.0% Potassium Permanganate ($KMnO_4$)
98.0% Water
The panel was rinsed off with water, dried and placed in a salt-fog according to ASTM method, B-117, for 336 hours. The panel showed no pits in the treated area.

The above procedures may be repeated at room temperature. However, the panel would then be immersed for longer periods of time and, in some cases, for approximately one hour instead of one minute.

In any of the above examples Lithium Chloride can be substituted for Sodium Chloride. The results are substantially the same and in some cases even better than those using NaCl. Of course, Lithium can be used, if desired, in addition to or as a substitute for the alkali metal salt used in any of the Examples noted in my co-pending application Ser. No. 06/908,827 and produce the desired results.

The following examples teach the use of additional materials which may be added, if desired, to treat various types of aluminum alloys.

EXAMPLE 10

An aluminum alloy panel of 6063 alloy has an average composition of:
0.4% silicon
0.7% magnesium and
98.9% aluminum
was degreased with mineral spirits and cleaned to a break-free surface with Triton X-100. After rinsing with D.I. water, the panel was immersed for five minutes in water containing less than 1.0 PPM impurities at 195°-212° F. This gave a tan color to the metal through the formation of a thin layer of boehmite (AlO . . . OH) on the aluminum surface. Further treatment of the panel at 180° F., for two minutes, in a solution of:
0.2% Potassium Permanganate ($KMnO_4$)
0.1% Sodium Silicate Pentahydrate ($Na_2Sio_3.5H_2O$)
0.1% Borax ($Na_2B_4O_7.5H_2O$)
0.1% Sodium Chloride (NaCl)
0.1% Sodium Nitrate ($NaNO_3$)
99.4% Water
gave a clean metallic color to the aluminum. After rinsing in D.I. water and drying, the panel was placed in a salt-fog at 95° F. according to ASTM method B-117 for 168 hours. The panel showed no noticeable pits in the treated area.

In the above similar results would be obtained if LiCl and/or $LiNO_3$ was partially or wholly substituted for the NaCl and/or $NaNO_3$.

EXAMPLE 11

An aluminum alloy panel of "6063" alloy was degreased with mineral spirits and cleaned to a breakfree surface with Triton X-100. After rinsing with D.I. water, the panel was sprayed with a stream of hot steam (220° F.-240° F.) to give a tan color to the aluminum alloy which is a layer of boehmite. Further treatment of the alloy at 180° F., for two minutes, in a solution of:
3.0% Potassium Permanganate ($KMnO_4$)
1.0 Sodium Chloride (NaCl)
0.1% Borax ($Na_2B_4O_7.5H_2O$)
1.0% Sodium Silicate Pentahydrate ($Na_2SiO_3.5H_2O$)
93.9% Water
gave a clean metallic color to the metal. After rinsing in D.I. water the panel was placed in a salt fog at 95° F. according to ASTM standard B-117 for 500 hours. There were no pits in the treated area.

In the above, similar results would be obtained if LiCl was partially or wholly substituted for NaCl.

EXAMPLE 12

An aluminum alloy panel of "2024" alloy (has an average a composition of: 4.4% cu, 0.6% Mn, 1.5% Mg and 93.5% Al) was degreased with mineral spirits and cleaned to a break-free surface with Triton X-100. After rinsing with D.I. water the panel was immersed for five minutes, in water containing less than 1.0 PPM impurities at 195° F.-212° F. This gave a tan color to the metal through the formation of a thin layer of boehmite (AlO . . . OH) on the metal surface. Further treatment of the panel at 180° F. for two minutes, in a solution of:
3.0% Potassium Permanganate ($KMnO_4$)
1.0% Lithium Chloride (LiCl)
1.0% Lithium Nitrate ($LiNO_3$)
0.5% Sodium Silicate Pentahydrate ($Na_2SiO_3.5H_2O$)
0.1% Borax ($Na_2B_4O_7.5H_2O$)
99.4% Water
gave a clean metallic color to the metal. After rinsing in D.I. water the panel was placed in an aqueous solution of Potassium silicate (0.83% $K_2O$ and 2.1% $SiO_2$) at 180° F. for two minutes. The panel was then rinsed with D.I. water and placed in an aqueous saturated lime ($Ca(OH)_2$) solution containing 1.0% lithium nitrate at 180° F. for two minutes. The panel was rinsed again in D.I. water, dried and placed in a salt-fog at 95° F. according to ASTM standard B-117 (sample placed at a 6° angle). After 168 hours of exposure, there were no pits in the treated area.

EXAMPLE 13

An aluminum alloy of "7075" alloy (has an average composition of 1.6% cu, 2.5% Mg, 0.23% Cr, 5.6% Zn, 90.07% Al) was degreased with mineral spirits and cleaned to a break-free surface with Triton X-100. After rinsing with D. I. water the panel was immersed, for five minutes, in water containing less than 1.0 PPM impurities at 195° F.-212° F. This gave a tan color to the metal through the formation of a thin layer of boehmite (AlO . . . OH) on the metal surface. Further treatment of the panel at 180° F., for two minutes, in a solution of:
3.0% Potassium Permanganate ($KMnO_4$)
1.0% Lithium Chloride (LiCl)
1.0% Lithium Nitrate ($LiNO_3$)
0.5% Sodium Silicate Pentahydrate ($Na_2SiO_3.5H_2O$)
0.1% Borax ($Na_2B_4O_7.5H_2O$)
gave a clean metallic color to the metal. After rinsing in D. I. water the panel was placed in an aqueous solution of potassium silicate (0.83% $K_2O$ amd 2.1% $SiO_2$) at 180° F. for two minutes. The panel was then rinsed in D. I. water an placed in an aqueous saturated lime ($Ca(OH)_2$) solution containing 1.0% lithium nitrate ($LiNO_3$) at 180° F. for two minutes. The panel was rinsed again in D. I. water, dried and placed in a salt fog at 95° F. according to ASTM standard B-117 (sample at 6° angle). After 168 hours of exposure there were no pits in the treated area.

EXAMPLE 14

An aluminum alloy panel of "7075" alloy was degreased with mineral spirits and cleaned to a break-free surface with Triton X-100. After rinsing with D.I. water the panel was placed in the following solution at 180° F. for two minutes:
3.0% potassium permanganate ($KMnO_4$)
1.0% Lithium Chloride (LiCl)
0.1% Borax ($Na_2B_4O_7.5H_2O$)
95.9% water
The dark brown colored panel was rinsed in D.I. water and then placed in the following solution at 180° F. for two minutes:
3.0% Potassium Permanganate ($KMnO_4$)
0.5% Lithium Carbonate ($Li_2CO_3$)
96.0% Water
After rinsing, the panel was placed in a salt fog at 95° F. according to standard ASTM method B-117 for 336 hours. There were no pits in the treated area.

EXAMPLE 15

An aluminum alloy panel of "2024" alloy (has an average a composition of: 4.4% cu, 0.6% Mn, 1.5% Mg and 93.5% Al) was degreased with mineral spirits and cleaned to a break-free surface with Triton X-100. After rinsing with D.I. water the panel was immersed for five minutes in water containing less than 1.0 PPM impurities at 195° F.–212° F. This gave a tan color to the metal through the formation of a thin layer of boehmite (AlO . . . OH) on the metal surface. Further treatment of the panel at 180° F. for two minutes, in a solution of:
3.0% Potassium Permanganate ($KMnO_4$)
2.0% Lithium Chloride (LiCl)
1.0% Lithium Nitrate ($LiNO_3$)
0.5% Sodium Silicate Pentahydrate ($Na_2SiO_3.5H_2O$)
93.5% Water
gave a clean metallic color to the metal. The panel was then rinsed with D. I. water and placed in an aqueous staturated lime ($Ca(OH)_2$) solution containing 1.0% lithium nitrate at 180° F. for two minutes. After rinsing in D.I. water the panel was placed in an aqueous solution of Potassium silicate (0.83% $K_2O$ and 2.1% $SiO_2$) at 180° F. for two minutes. The panel was rinsed again in D.I. water, dried and placed in a salt-fog at 95° F. according to ASTM standard B-117 (sample placed at a 6° angle). After 336 hours of exposure, there were no pits in the treated area.

EXAMPLE 16

An aluminum alloy of "7075" alloy (has an average composition of 1.6% cu, 2.5% Mg, 0.23% Cr, 5.6% Zn, 90.07% Al) was degreased with mineral spirits and cleaned to a break-free surface with Triton X-100. After rinsing with D. I. water the panel was immersed, for five minutes, in water containing less than 1.0 PPM impurities at 195° F.–212° F. This gave a tan color to the metal through the formation of a thin layer of boehmite (AlO . . . OH) on the metal surface. Further treatment of the panel at 180° F., for two minutes, in a solution of:
3.0% Potassium Permanganate ($KMnO_4$)
2.0% Lithium Chloride (LiCl)
1.0% Lithium Nitrate ($LiNO_3$)
0.5% Sodium Silicate Pentahydrate ($Na_2SiO_3.5H_2O$)
93.5% Water
gave a clean metallic color to the metal. The panel was then rinsed in D. I. water and placed in an aqueous saturated lime ($Ca(OH)_2$) solution containing 1.0% lithium nitrate ($LiNO_3$) at 180° F. for two minutes. After rinsing in D. I. water the panel was placed in an aqueous solution of potassium silicate (0.83% $K_2O$ and 2.1% $SiO_2$) at 180° F. for two minutes. The panel was then rinsed again in D. I. water, dried and placed in a salt fog at 95° F. according to ASTM standard B-117 (sample at 6° angle). After 336 hours of exposure there were no pits in the treated area.

Some of the above examples show the use of Salt (NaCl or LiCl) and permanganate or of Salt (NaCl or LiCl), permanganate and phosphate in the protection of non-copper alloys, such as 3003-H14, and low copper alloys such as "6061".

Other of the above examples show the use of silicates with borax and permanganate in the protection of high copper (2024) and zinc (7075) alloys.

The above silicate compositions of Examples 12–18 generally have a pH range of about 12–14. Since the borates convert to metaborates at a pH above 11, the borax in the composition is the corresponding metaborate.

Our examples show a substantial improvement over a potassium permanganate-sodium hydroxide composition and over the use of chromate compositions. Our compositions do not have the toxicity of the chromates and are therefore more environmentally effective. Further, with our compositions, there is no need to use hydroxide to remove oils and greases. This also provides a safer working environment.

I claim:

1. An alkali metal permanganate coating composition for aluminum and aluminum alloys comprising a basic pH and having as the essential ingredients thereof an alkali metal permanganate and an alkali metal chloride.

2. The composition of claim 1 wherein the permanganate is potassium permanganate and the chloride is sodium chloride and/or lithium chloride.

3. The composition of claim 1 which includes a compound selected from the group consisting of an alkali metal tetraborate, alkali metal metaborate, benzoic acid, alkali metal benzoate, alkali metal carbonate, a mixture of the alkali metal tetra and metaborate, and the hydrated alkali metal meta and/or tetraborate.

4. The composition of claim 3 wherein one of the essential ingredients is selected from the group consisting of hydrated sodium tetraborate, hydrated sodium metaborate and mixtures thereof.

5. The composition of claim 1 which is an aqueous permanganate solution having a pH in the range of 7 to 12.5.

6. The composition of claim 5 wherein the pH is in the range of 9 to 10.

7. The composition of claim 5 which includes a compound selected from the group consisting of alkali metal tetraborate, alkali metal metaborate, alkali metal benzoate, alkali metal carbonate, benzoic acid, mixtures of the alkali metal tetra and metaborate, and the hydrated alkali metal meta and/or tetraborates.

8. The composition of claim 7 which contains as essential ingredients, potassium permanganate, sodium and/or lithium chloride and sodium tetraborate.

9. The composition of claim 5 which contains as essential ingredients potassium permanganate and sodium and/or lithium chloride.

10. The composition of claim 2 which contains:
0.05 to 10% by weight NaCl and/or LiCl, and
0.2 to 6.3% by weight $KMnO_4$.

11. The composition of claim 4 which contains:
0.05 to 9% by weight borax-$5H_2O$
0.2 to 6.3% by weight of $KMnO_4$, and
0.05 to 10% by weight of NaCl and/or LiCl.

12. The composition of claim 1 wherein the composition contains:
0.05% to 44% by weight of alkali metal benzoate,
0.2 to 6.3% by weight of $KMnO_4$
0.05 to 10% by weight of LiCl.

13. The composition of claim 3 wherein the composition contains:
0.5% to 31.5% by weight of sodium carbonate,
0.2 to 6.3% by weight of $KMnO_4$, and
0.5 to 10% by weight of NaCl and/or LiCl.

14. The composition of claim 1 wherein all percentages are by weight and selected from the group consisting of those containing as essential ingredients:
(a) 0.1% borax-$5H_2O$, 0.2% $KMnO_4$, 0.1% NaCl;
(b) 0.5% borax-$5H_2O$, 1.0% $KMnO_4$, 0.5% NaCl;
(c) 4.0% $KMnO_4$, 0.1% NaCl;
(d) 0.2% $KMnO_4$, 5.0% NaCl;

15. A method of protecting aluminum and aluminum alloys with an alkali metal permanganate protective coating comprising cleaning the aluminum or aluminum alloy surface with a nonionic non-interfering surfactant selected from polyoxyethylene or polyoxypropylene derivatives of organic acids, alcohols, alkyphenols or amines contacting the cleaned aluminum or alloy with an aqueous alkali metal permanganate solution having a pH in the range of 7 to less than 12.5, forming a conversion coating on the aluminum or alloy, and removing any excess coating solution from the aluminum or alloy.

16. The method of claim 15 wherein the pH of the permanganate solution is in the range of 9 to 10.

17. The method of claim 15 wherein the permanganate solution also contains as an essential ingredient a compound selected from alkali metal tetraborate, alkali metal metaborate, alkali metal carbonates, benzoic acid, alkali metal benzoate, mixtures of alkali metal meta-and tetraborate, and the hydrated alkali metal meta and/or tetraborate.

18. The method of claim 15 wherein the permanganate solution also contains as an essential ingredient an alkali metal chloride.

19. The method of claim 17 wherein the permanganate solution also contains as an essential ingredient an alkali metal chloride.

20. The method of claim 18 wherein the chloride is sodium chloride or lithium chloride.

21. The method of claim 15 wherein the permanganate solution is selected from the following wherein all percentages are by weight:
(a)
0.2% to 6.3% alkali metal permanganate;
0.05 to 10.0% alkali metal chloride; and remainder water.
(b)
0.2% to 6.3% alkali metal permanganate;
0.05% to 9% alkali metal borates and their hydrates and,
0.05 to 10% alkali metal chloride, and remainder water.
(c)
0.2 to 6.3% alkali metal permanganate;
0.05 to 9% alkali metal borates and their hydrates and the remainder water.
(d)
0.2 to 6.3% alkali metal permanganate;
0.05 to 44% alkali metal benzoate, and the remainder water.
(e)
0.2 to 6.3% alkali metal permanganate;
0.05 to 31.5% alkali metal carbonate, and the remainder water.
(f)
0.2 to 6.3% alkali metal permanganate;
0.05 to 10% alkali metal chloride;
0.05 to 44% alkali metal benzoate, and the remainder water, and
(g)
0.2 to 6.3% alkali metal permanganate;
0.05 to 10% alkali metal chloride;
0.05% to 31.5% alkali metal carbonate, and the remainder water.

22. An alkali metal permanganate coating composition for aluminum and aluminum alloys comprising a basic pH and having as the essential ingredient thereof an alkali metal permanganate, an alkali metal silicate, and a compound selected from the group consisting of an alkali metal tetraborate, alkali metal metaborate, benzoic acid, alkali metal benzoate, alkali metal carbonate, a mixture of the alkali metal tetra and metaborate, and alkali metal hydrated metra and/or tetraborate.

23. The composition of claim 22 wherein one of the essential ingredients is selected from the group consisting of hydrated sodium tetraborate, hydrated sodium metaborate and mixtures thereof.

24. The composition of claim 23 which includes an alkali metal chloride.

25. The composition of claim 24 which includes an alkali metal nitrate.

26. The composition of claim 25 wherein the nitrate is sodium and/or lithium nitrate, the silicate is hydrated sodium silicate, and the chloride is sodium chloride and/or lithium chloride.

27. The composition of claim 23 wherein the permanganate is potassium permanganate, and the silicate is hydrated sodium silicate.

28. The composition of claim 27 wherein the aqueous permanganate solution has a pH in the range of 12 to 14.

29. The composition of claim 27 wherein all of the percentages are by weight and contain as essential ingredients:
0.2 to 6.3% $KMnO_4$ 0.05 to 10% NaCl and/or LiCl
0.1 to 35% hydrated sodium silicate
0 to 10% $NaNO_3$ and/or $LiNO_3$
0.1 to 35% borax which at a pH of over 11 is partially or wholly converted to the metaborate.

30. The composition of claim 29 wherein the essential ingredients are selected from the group consisting of:
(a) 0.2% $KMnO_4$, 0.1% hydrated $Na_2SiO_3$, 0.1% Borax; 0.1% NaCl, 0.1% $NaNO_3$;
(b) 3.0 $KMnO_4$, 1.0% hydrated $Na_2SiO_3$, 0.1% Borax; 1.0% NaCl;
(c) 3.0% $KMnO_4$, 0.5% hydrated $Na_2SiO_3$, 0.1% Borax, 1.0% LiCl, 1.0% $LiNO_3$;
(d) 3.0% $KMnO_4$, 0.5% hydrated $Na_2SiO_3$, 0.1% Borax, 1.0% LiCl; 1.0% $LiNO_3$;
(e) 3.0% $KMnO_4$, 0.1% borax, 1.0% LiCl; and
(f) 3.0% $KMnO_4$, 0.5% $Li_2CO_3$.

31. A method of protecting aluminum and aluminum alloys with an alkali metal permanganate protective coating comprising cleaning the aluminum or aluminum alloy surface with a nonionic non-interfering surfactant selected from polyoxyethylene or polyoxypropylene derivatives of organic acids, alcohols, alkyphenols or amines, contacting the cleaned aluminum or alloy with an aqueous alkali metal permanganate solution having a base pH of less than 14.0, forming a conversion coating on the aluminum or alloy, and removing any excess coating solution from the aluminum or alloy.

32. The method of claim 31 wherein the permanganate solution contains as essential ingredients
0.2 to 6.3 $KMnO_4$
0.05 to 10% NaCl and/or LiCl
0.1 to 35% hydrated sodium silicate
0 to 10% $NaNO_3$ and/or $LiNO_3$
0.1 to 35% borax which at a pH of over 11 is partially or wholly converted to the metaborate.

33. The method of claim 31 wherein the permanganate solution is selected from the following wherein all percentages are by weight and the remainder of each is water:
(a) 0.2% $KMnO_4$, 0.1% hydrated $Na_2SiO_3$, 0.1% Borax; 0.1% NaCl, 0.1% $NaNO_3$;
(b) 3.0 $KMnO_4$, 1.0% hydrated $Na_2SiO_3$, 0.1% Borax; 1.0% NaCl;
(c) 3.0% $KMnO_4$, 0.5% hydrated $Na_2SiO_3$, 0.1% Borax, 1.0% LiCl, 1.0% $LiNO_3$;
(d) 3.0% $KMnO_4$, 0.5% hydrated $Na_2SiO_3$, 0.1% Borax, 1.0% LiCl; 1.0% $LiNO_3$;
(e) 3.0% $KMnO_4$, 0.1% borax, 1.0% LiCl; and
(f) 3.0% $KMnO_4$, 0.5% $Li_2CO_3$.

34. The method of claim 32 wherein an aluminum alloy having greater than 1.0% Cu immersed in water at a temperature of between 180°–212° F. to provide an aluminum oxide coating thereon, then treating the oxide coated aluminum alloy with the permanganate solution, rinsing the permanganate treated alloy, contacting the rinsed alloy with an alkali metal silicate, rinsing the silicated treated alloy with a solution of $Ca(OH)_2$ and alkali metal nitrate and then rinsing the alloy to recover the protected alloy.

35. The method of claim 34 wherein the permanganate solution contains as essential ingredients, potassium permanganate, lithium chloride, lithium nitrate, hydrated sodium silicate, and borax; the alkali metal silicate is potassium silicate; and the alkali metal nitrate is lithium nitrate.

36. The method of claim 32 wherein an aluminum alloy having greater than 4% Zn is first cleaned and then treated with said permanganate solution, rinsed and then treated with a second permanganate solution containing as essential ingredients alkali metal permanganate and alkali metal carbonate.

37. The method of claim 36 wherein said permanganate solution contains as essential ingredients potassium permanganate, alkali metal chloride, and borax.

38. The method of claim 37 wherein said alkali metal chloride is lithium chloride and said alkali metal carbonate is lithium carbonate.

* * * * *